US006416444B1

(12) United States Patent
Lim et al.

(10) Patent No.: US 6,416,444 B1
(45) Date of Patent: Jul. 9, 2002

(54) TREADMILL HAVING A WALKING BELT WHOSE RUNNING SPEED IS AUTOMATICALLY ADJUSTED

(75) Inventors: Jung Soo Lim, Kaepo 1-Cha Woosung Apt. 1-1502, #503 Daechi-dong, Kangnam-ku, Seoul (KR); Byung Don Lee, Seoul (KR)

(73) Assignee: Jung Soo Lim, Seoul (KR)

( * ) Notice: Subject to any disclaimer, the term of this patent is extended or adjusted under 35 U.S.C. 154(b) by 0 days.

(21) Appl. No.: 09/598,371

(22) Filed: Jun. 21, 2000

(30) Foreign Application Priority Data

Jan. 20, 2000 (KR) ..... 2000-2711
May 12, 2000 (KR) ..... 2000-25286

(51) Int. Cl.[7] ..... A63B 22/00

(52) U.S. Cl. ..... 482/54; 482/51

(58) Field of Search ..... 482/51, 54

(56) References Cited

U.S. PATENT DOCUMENTS 5,312,310 A * 5/1994 Shimizu et al. ..... 482/54
5,476,430 A 12/1995 Lee et al. ..... 482/54
5,690,587 A 11/1997 Gruenangerl ..... 482/54
5,707,319 A 1/1998 Riley ..... 482/54
6,050,822 A * 4/2000 Faughn ..... 482/54
6,135,924 A * 10/2000 Gibbs et al. ..... 482/54

* cited by examiner

*Primary Examiner*—Glenn E. Richman
(74) *Attorney, Agent, or Firm*—Troxell Law Office PLLC

(57) ABSTRACT

A treadmill having a walking belt whose running speed is automatically adjusted in conformity with the walking or running speed of a user, without any manipulation of a walking belt speed control button, and a method for automatically adjusting the running speed of a walking belt in a treadmill. The treadmill of the present invention first checks and determines whether the rotation speed of the motor is deviated from an initial set range or the user is deviated from his original position and then if any one of the two deviations is checked, automatically increase or decrease the rotation speed of the motor.

2 Claims, 4 Drawing Sheets

TREADMILL HAVING A WALKING BELT WHOSE RUNNING SPEED IS AUTOMATICALLY ADJUSTED

BACKGROUND OF THE INVENTION

1. Field of the Invention

The present invention relates to a treadmill as a kind of indoor sporting goods, and more particularly, to a treadmill having a walking belt whose running speed is automatically adjusted in conformity with the walking or running speed of a user, without any manipulation of a walking belt speed control button, and a method for automatically adjusting the running speed of a walking belt in a treadmill.

2. Discussion of Related Art

Generally, a treadmill as indoor sporting goods is widely spread. As well known, the treadmill allows a user to walk or lightly run on a walking belt moving in a forward direction. The advantages obtained by using the treadmill are as follows: firstly, the exercise on the treadmill is taken even in a small area; and secondly, the obtained effect from the exercise on the treadmill is influenced to the whole body of the user. Because of such advantages, the number of persons using treadmill has been gradually increased.

When the user desires to walk or run at a faster or slower speed during walking or running on the walking belt, however, the user should accelerate or decelerate the running speed of the walking belt in conformity with the desired speed. In this case, there occurs an inconvenience that even during he walks or runs, he has to adjust the walking belt speed control button on the instrument panel.

If the user walks or runs at the faster speed in the state where the walking belt speed control button on the instrument panel has not been adjusted, his body moves forward and is then adjacent to the instrument panel (that is, the foremost front of the treadmill), such that he can not further walk on the walking belt. To the contrary, if he walks or runs at the slower speed in the state where the walking belt speed control button on the instrument panel has not been adjusted, his body moves backward and is then adjacent to the last rear portion of the treadmill, such that he can not further walk on the walking belt.

SUMMARY OF THE INVENTION

Accordingly, the present invention is directed to a treadmill having a walking belt whose running speed is automatically adjusted that substantially obviates one or more of the problems due to limitations and disadvantages of the related arts.

An object of the invention is to provide a treadmill having a walking belt whose running speed is automatically adjusted in conformity with the walking or running speed of a user, without any manipulation of a walking belt speed control button, when he walks or runs at faster or slower speed than a while ago, and a method for automatically adjusting the running speed of a walking belt in a treadmill.

To accomplish this and other objects of the present invention, a treadmill according to the present invention comprises an encoder for checking the rotation speed of a motor, and an electric current detecting sensor for detecting the load of the motor. The encoder and the electric current detecting sensor act as a motor driving unit, which checks even a minor change in the rotation speed or load of the motor caused by a user who walks or runs on a walking belt, determines the necessity of increasing or decreasing the rotation speed of the motor, and increase or decrease the rotation speed of the motor in a very short time that the user may not realize.

When the walking belt of the treadmill is driven by the activation of the motor, the rotation speed of the motor is varied momentarily in accordance with the weight and motion speed of the user during walking or running on the walking belt. Let's assume that the motor rotates at 400 rpm in the state where the user is not positioned on the walking belt. If the user is positioned on the walking belt, the rotation speed of the motor is reduced momentarily to, for example, 200–350 rpm, depending upon his weight. Then, after a predetermined time elapses, the rotation speed thereof is again kept at 400 rpm.

According to the present invention, the treadmill is capable of increasing or decreasing the running speed of the motor by sensing the fact that the walking or running speed of the user does not correspond with the running speed of the walking belt. During the user runs on the walking belt at the corresponding speed to a constant running speed of about 8 km/hr or more of the walking belt, if he runs at a slower speed, the running speed of the walking belt is faster than the running speed of the user and thereby, the body of the user moves backward. At this time, the user's foot moving forward functions as a brake when stepping on the walking belt, such that the running speed of the walking belt can be decreased. This causes the rotation speed of the motor to be reduced. If the rotation speed of the motor is reduced to a lowest allowable value of an initial set value, the encoder feedback from the motor is checked to thereby re-adjust the set value.

On the other hand, during the user runs on the walking belt if he runs at a faster speed, the running speed of the walking belt increases temporarily. This means the principles that the user adds a driving force to his feet placed on the ground, thereby advancing forward. If the above principles are applied on the walking belt during rotation, the current speed of the walking belt increases by the driving force of the user's feet placed on the ground. This causes the rotation speed of the motor to increase. If the rotation speed of the motor increases a highest allowable value of the initial set value, the encoder feedback from the motor is checked to re-adjust the set value.

Moreover, according to the present invention, the treadmill is capable of increasing or decreasing the running speed of the motor by sensing the fact that the user moves from his original position to the front or back regions of the walking belt. As previously discussed, if the user walks or runs at the faster speed than the set running speed of the walking belt, he is deviated from his original position to advance forward. Contrarily, if the user walks or runs at the slower speed than the set running speed of the walking belt, he is deviated from his original position to advance backward. The deviation of the user from the original position means that the walking or running speed of the user increases or decreases. Therefore, it is checked whether the user is deviated from his original position, and in accordance with the checked result, the rotation speed of the motor increases or decreases. As a result, the rotation speed of the motor can be adjusted in conformity with the walking or running speed of the user.

On the basis of the above discussion, the treadmill according to the present invention first checks and determines whether the rotation speed of the motor is deviated from an initial set range or the user is deviated from his original position and then if only one of the two deviations is checked, automatically increase or decrease the rotation speed of the motor.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings. In the drawings.

DETAILED DESCRIPTION OF PREFERRED EMBODIMENT

Reference will now be made in detail to the preferred embodiments of the present invention, examples of which are illustrated in the accompanying drawings.

Figure 1:
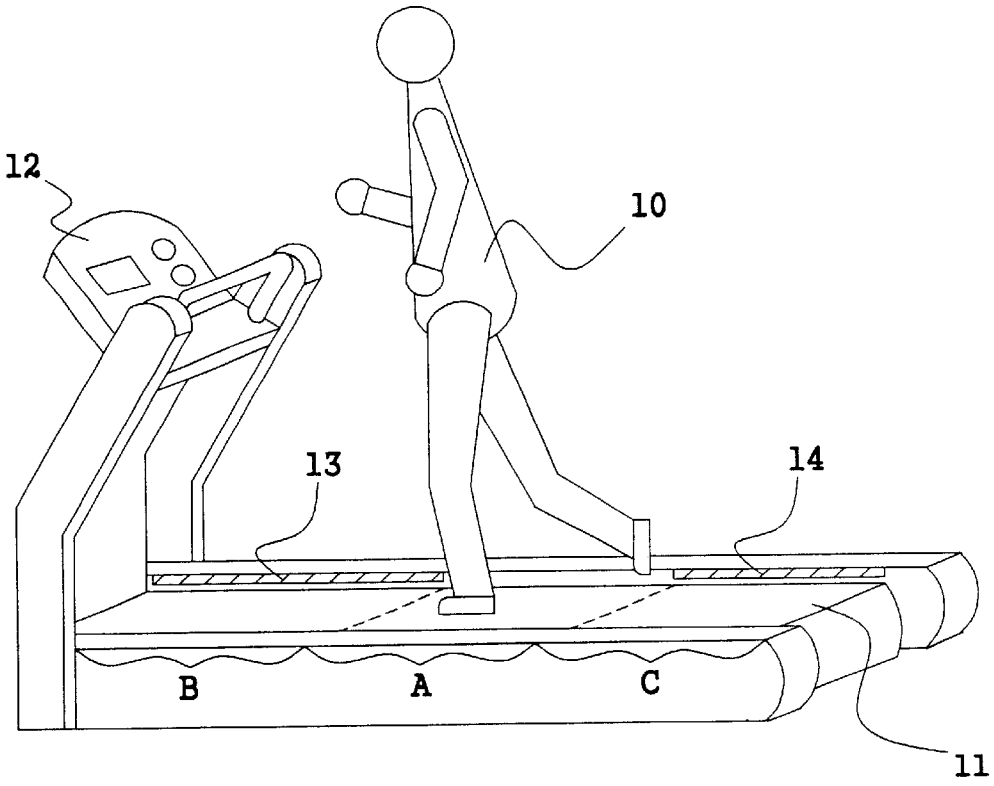
FIG. 1 is a schematically exemplary view of a treadmill according to the present invention.

FIG. 1 is a schematically exemplary view of a treadmill according to the present invention. A user 10 walks or runs on the intermediate region 'A' of a walking belt 11, and when an initially set running speed of the walking belt 11 corresponds to the walking or running speed of the user on the walking belt 11, the user 10 is positioned within the intermediate region 'A'. However, if the walking or running speed of the user is faster than the set speed of the walking belt 11, the user 10 is naturally positioned on a front region 'B'. If his feet are placed on the front region 'B', due to the installation of a sensor 13 on the left and right sides of the walking belt 11, the sensor 13 senses the fact that the user is on the front region 'B' and sends a speed increasing command to a motor (not shown).

As shown, the walking belt 11 is divided into the intermediate region 'A', the front region 'B' and the rear region 'C' by the dotted line, which is an imaginary line for the brevity of explanation.

It is assumed that the initially set value of the rotation speed (which is set by the user when he walks or runs on the treadmill) of the motor is '$V_0$'. Also, it is assumed that the momentarily varying range of the rotation speed of the motor during the walking or running is '$\alpha$'. The real rotation speed '$V_1$' of the motor when the user 10 is positioned within the intermediate region 'A' becomes $V_0-\alpha \leqq V_1 \leqq V_0+\alpha$. By way of example, assuming that the initially set value (hereinafter, referred to as "reference rotation speed") of the rotation speed of the motor '$V_0$'=300 rpm and the allowable varying value of the rotation speed thereof '$\alpha$'=40 rpm, the real rotation speed 'V1' of the motor is 260–340 rpm.

Under the above state, if the speed increasing command issued from the front sensor 13 is sent to the motor, the reference rotation speed of the motor increases by '$\gamma$'. At this time, the real rotation speed '$V_2$' of the motor is within the range of $V_0+\gamma-\alpha \leqq V_2 \leqq V_0+\gamma+\alpha$. Herein, the value '$\gamma$' is arbitrarily determined by the manufacturer of the treadmill.

When the motor rotates at the speed of '$V_2$', the running speed of the walking belt is accelerated to the corresponding speed, and in the case where the running speed of the walking belt corresponds with the walking or running speed of the user, he moves from the front region 'B' to the intermediate region 'A'. As a consequence, the speed increasing command from the front sensor 13 is not further generated and the motor rotates while maintaining the range of $V_0+\gamma-\alpha \leqq V_2 \leqq V_0+\gamma+\alpha$.

Even if the rotation speed of the motor increases by '$\gamma$', however, when the running speed of the walking belt is lower than the walking or running speed of the user, he is continuously positioned on the front region 'B'. As a consequence, the speed increasing command from the front sensor 13 is further sent to the motor and at this time, since the rotation speed of the motor increases by '$\gamma$', the motor rotates within the range of $V_0+2\gamma-\alpha \leqq V_3 \leqq V_0+2\gamma+\alpha$. Thereafter, until the user is positioned on the intermediate region 'A' to prevent the speed increasing command from the front sensor 13 from generating, the above process is repeated.

On the other hand, if the walking or running speed of the user is slower than the set speed of the walking belt 11, the user 10 is naturally positioned on the rear region 'C'. If his feet are placed on the rear region 'C', due to the installation of a sensor 14 on the left and right sides of the walking belt 11 the sensor 14 senses the fact that the user is on the rear region 'C' and sends a speed decreasing command to a motor (not shown).

If the speed decreasing command issued from the rear sensor 14 is sent to the motor, the reference rotation speed of the motor decreases by '$\gamma$'. At this time, the real rotation speed '$V_4$' of the motor is within the range of $V_0-\gamma-\alpha \leqq V_4 \leqq V_0-\gamma+\alpha$ (herein, the value '$\gamma$' is arbitrarily determined by the manufacturer of the treadmill).

When the motor rotates at the speed of '$V_4$', the running speed of the walking belt is decelerated to the corresponding speed, and in the case where the running speed of the walking belt corresponds with the walking or running speed of the user, he moves from the rear region 'C' to the intermediate region 'A'. As a consequence, the speed decreasing command from the rear sensor 14 is not further generated and the motor rotates while maintaining the range of $V_0-\gamma-\alpha \leqq V_2 \leqq V_0-\gamma+\alpha$.

Even if the rotation speed of the motor decreases by '$\gamma$', however, when the running speed of the walking belt is faster than the walking or running speed of the user, he is continuously positioned on the rear region 'C'. As a consequence, the speed decreasing command from the rear sensor 14 is further sent to the motor and at this time, since the rotation speed of the motor decreases by '$\gamma$', the motor rotates within the range of $V_0-2\gamma-\alpha \leqq V_3 \leqq V_0-2\gamma+\alpha$. Thereafter, until the user is positioned on the intermediate region 'A' to prevent the speed decreasing command from the rear sensor 14 from generating, the above process is repeated.

The series of processes as mentioned above are illustrated in FIG. 2.

Even though the user is not deviated from the intermediate region 'A', the rotation speed of the motor may increase or decrease momentarily to cause the imbalance with the walking or running speed of the user. This is because of the difference between the rotation speed of the motor when the user is not on the walking belt and when the user walks at a slow or fast speed on the walking belt, in case of using a motor driving unit for driving the walking belt of the treadmill.

In consideration with the fact as discussed above, the treadmill according to the present invention is capable of checking a feedback from an encoder and an electric current detecting sensor attached to the motor and, when the rotation speed of the motor is over a highest allowable value of the reference rotation speed or under a lowest allowable value thereof, adjusting the rotation speed of the motor. For instance, assume that the reference rotation speed of the motor is '$V_0$', and the real rotation speed '$V_1$' of the motor at the time when the user is positioned within the intermediate region 'A' is within the range of $V_0-\alpha \leqq V_1 \leqq V_0+\alpha$. Then, if the momentary rotation speed of the motor is under $V_0-\alpha$ or over $V_0+\alpha$, the rotation speed of the motor is adjusted.

That is to say, if the rotation speed '$V_x$' of the motor is under $V_0-\alpha$, the motor senses the fact and decreases the reference rotation speed by '$\gamma$', such that the reference rotation speed has the value of $V_0-\gamma$ (where the value '$\gamma$' is arbitrarily determined by manufacturers of the treadmill). At this time the motor rotates within the range of $V_0-\gamma-\alpha$ or more and $V_0-\gamma+\alpha$ or less.

If the rotation speed '$V_x$' of the motor is within the range of $V_0-\gamma-\alpha<V_x \leqq V_0-\alpha$, the motor does not need further speed adjustment, but if within the range of $V_x<V_0-\gamma-\alpha$, the reference rotation speed further decreases by '$\gamma$'. As a consequence, a new reference rotation speed of the motor is set to $V_0-2\gamma$, and the motor rotates within the range of $V_0-2\gamma-\alpha$ or more and $V_0-2\gamma+\alpha$ or less. Then, the current rotation speed '$V_x$' of the motor is compared with the value of $V_0-2\gamma-\alpha$, and if $V_x<V_0-2\gamma-\alpha$, the reference rotation speed thereof is readjusted until the current rotation speed '$V_x$' of the motor corresponds to the new reference rotation speed.

Similarly, if the rotation speed '$V_x$' of the motor is over $V_0+\alpha$, the motor senses the fact and increases the reference rotation speed by '$\gamma$', such that the new reference rotation speed has the value of $V_0+\gamma$. At this time, the motor rotates within the range of $V_0+\gamma-\alpha$ or more and $V_0+\gamma+\alpha$ or less.

If the rotation speed '$V_x$' of the motor is within the range of $V_0+\alpha \leqq V_x \leqq V_0+\gamma+\alpha$, the motor does not need further speed adjustment, but if within the range of $V_x>V_0+\gamma+\alpha$, the reference rotation speed further increases by '$\gamma$'. Thus, a new reference rotation speed of the motor is set to $V_0+2\gamma$, and the motor rotates within the range of $V_0+2\gamma-\alpha$ or more and $V_0+2\gamma+\alpha$ or less. Then, the current rotation speed '$V_x$' of the motor is compared with the value of $V_0+2\gamma+\alpha$, and if $V_x>V_0+2\gamma+\alpha$, the reference rotation speed thereof is re-adjusted until the current rotation speed '$V_x$' of the motor corresponds to the new reference rotation speed.

Figure 2:
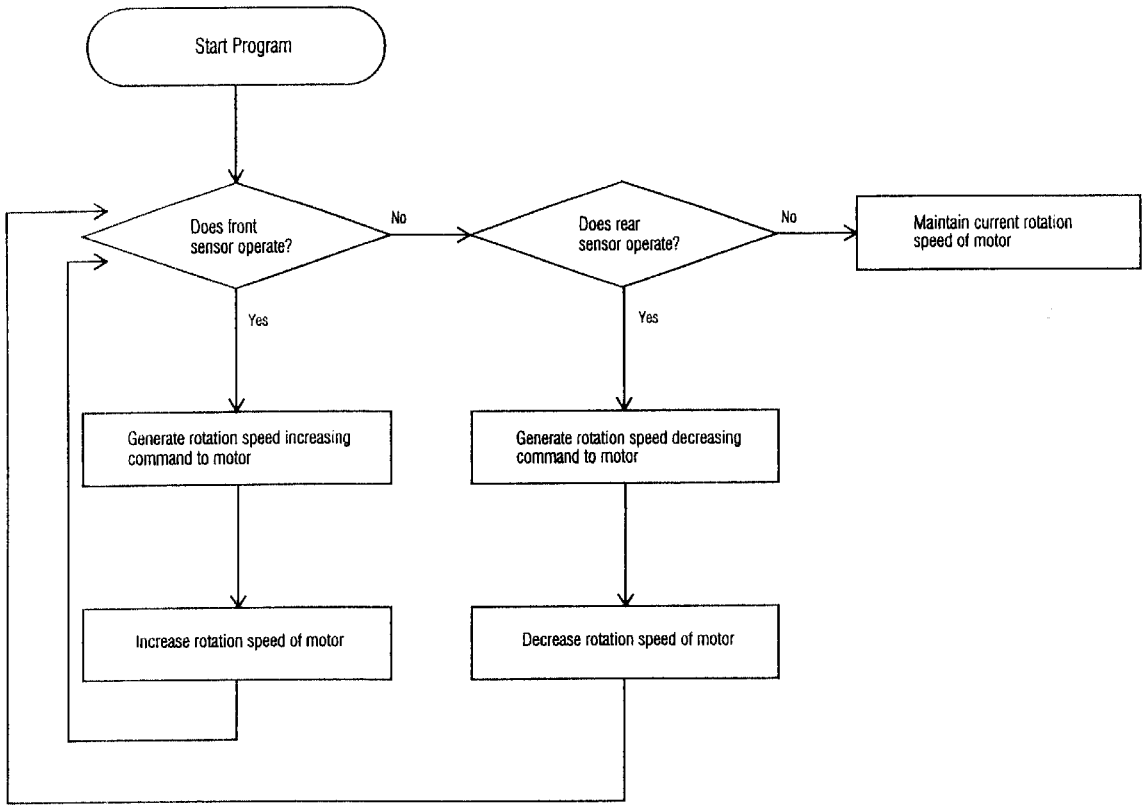
FIG. 2 is a flowchart illustrating motor automatic speed adjusting steps for the treadmill according to the present invention, when a user is deviated from the intermediate region of the walking belt.
Figure 3:
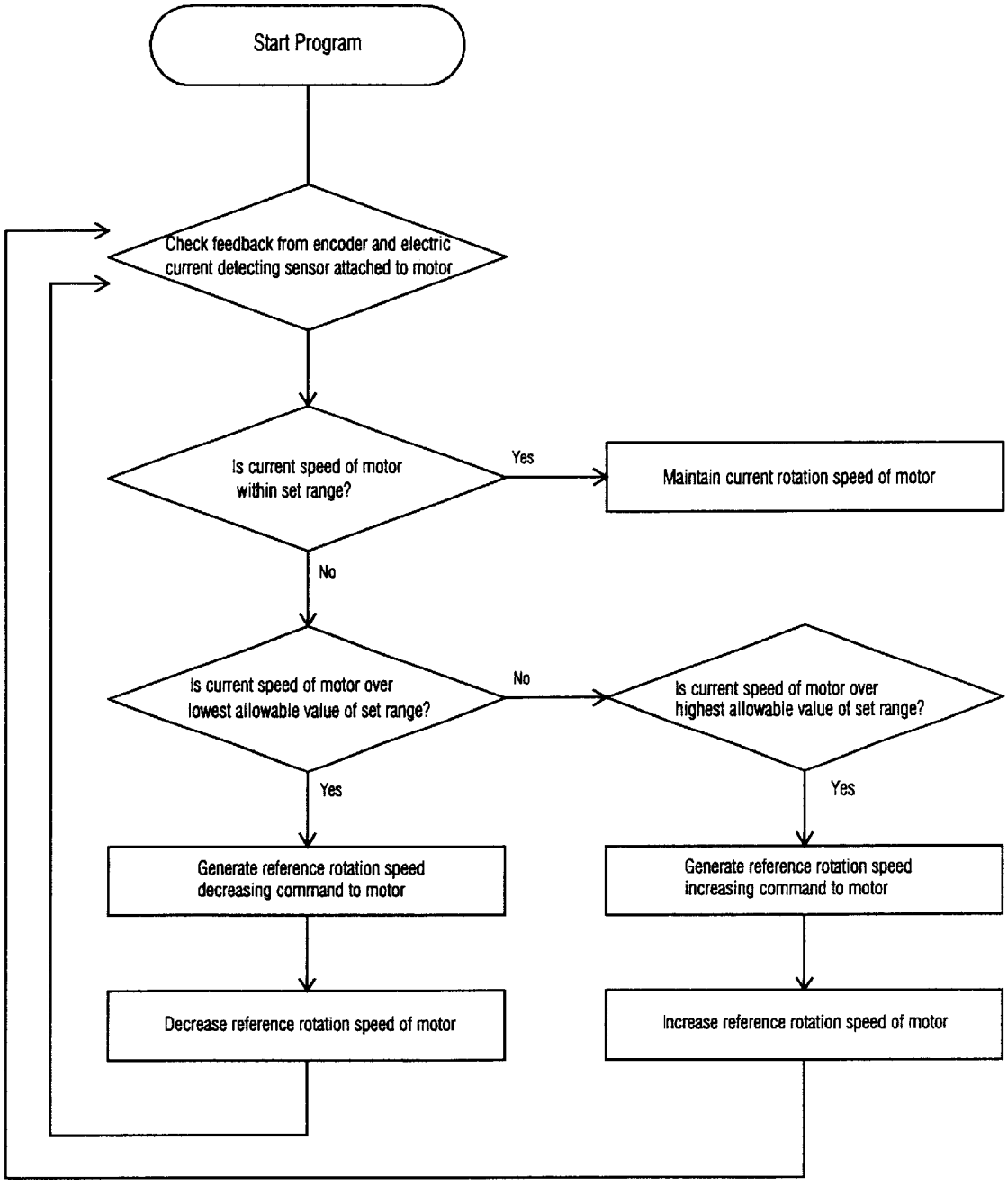
FIG. 3 is a flowchart illustrating motor speed adjusting steps for the treadmill according to the present invention, when the rotation speed of the motor is over an allowable value.
Figure 4:
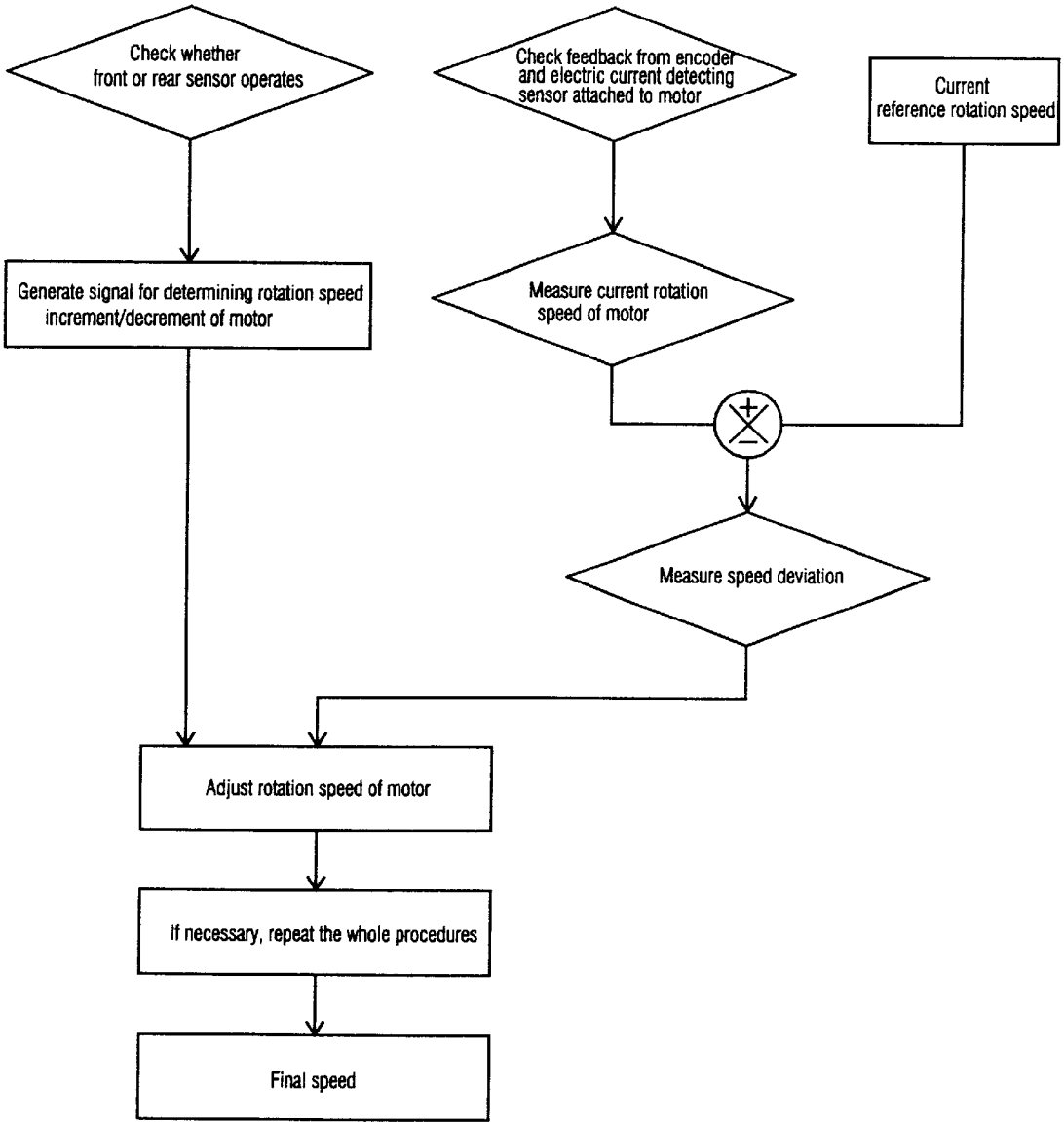
FIG. 4 is a flowchart illustrating the combined result of FIGS. 2 and 3.

The series of processes as discussed above are illustrated in FIG. 3, and FIG. 4 is a flowchart illustrating the combined result of FIGS. 2 and 3.

As set forth in the above, a treadmill according to the present invention comprises a walking belt whose running speed is automatically adjusted in conformity with the walking or running speed of a user, without any manipulation of a walking belt speed control button on an instrument panel, thereby providing the same effect as walks or runs naturally on the ground.

Until now, in order to overcome strong disadvantages that most of indoor sporting goods have failed to provide a satisfactory or natural movement to their users, heavy efforts for developing improved indoor sporting goods which are capable of providing the same exercise environment as in the natural state are made unceasingly by many manufactures. Of course, the treadmill according to the present invention can solve the problems as suffered in the conventional practice and provide the same exercise environment as in the natural state, which will result in the tremendous development in the indoor sporting goods.

It will be apparent to those skilled in the art that various modifications and variations can be made in a treadmill having a walking belt whose running speed is automatically adjusted according to the present invention without departing from the spirit or scope of the invention. Therefore, it is intended that the present invention cover the modifications and variations of this invention provided they come within the scope of the appended claims and their equivalents.

What is claimed is:

1. A treadmill, which comprises:

an endless belt having a surface on which a user may walk or run;

a motor driving said endless belt;

a front sensor located adjacent to the surface in a front portion of the endless belt and extending generally parallel to a direction of movement of said endless belt to sense the presence of said user in the front portion of said endless belt, and generating a speed increasing command to said motor to increase a speed of the endless belt; and a rear sensor located adjacent to the surface in a rear portion of the endless belt and extending generally parallel to the direction of movement of said endless belt and to sense the presence of said user in the rear portion of said endless belt, and generating a speed decreasing command to said motor to decrease the speed of the endless belt.

2. The treadmill according to claim 1, further comprising:

an encoder and an electric current detecting sensor attached to said motor to measure a current rotation speed of said motor;

means for decreasing, when said current rotation speed of said motor is below a predetermined set range, a reference speed of said predetermined set range to cause said current rotation speed of said motor to be within a newly set range; and means for increasing, when said current rotation speed of said motor is above said predetermined set range, said reference speed of said predetermined set range to cause said current rotation speed of said motor to be within a newly set range.

* * * * *